US006879256B1

(12) United States Patent
Redfern et al.

(10) Patent No.: US 6,879,256 B1
(45) Date of Patent: Apr. 12, 2005

(54) SEAL COMPRESSION INDICATION SYSTEM

(75) Inventors: Robert Charles Redfern, Glassboro, NJ (US); Ted Arthur Heinritz, King of Prussia, PA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 6 days.

(21) Appl. No.: 10/654,885

(22) Filed: Sep. 5, 2003

(51) Int. Cl.[7] ..... G08B 13/08

(52) U.S. Cl. ..... 340/545.3; 340/545.6; 277/321; 49/472

(58) Field of Search ..... 340/545.3, 545.6, 340/550, 598, 647, 679; 277/317, 320, 321, 919; 49/472, 473, 475.1

(56) References Cited

U.S. PATENT DOCUMENTS 5,216,840 A 6/1993 Andrews
5,295,326 A 3/1994 Dickey
5,553,871 A 9/1996 Rowe et al.
5,565,843 A * 10/1996 Meyvis ..... 340/691.6
6,317,489 B1 * 11/2001 Parsadayan ..... 379/102.06
6,329,617 B1 12/2001 Burgess
6,465,752 B1 10/2002 Meagher et al.
6,494,464 B1 * 12/2002 Chandler et al. ..... 277/628

* cited by examiner

*Primary Examiner*—John Tweel, Jr.
(74) *Attorney, Agent, or Firm*—Steven W. Crabb

(57) ABSTRACT

A watertight door seal compression indication apparatus is provided that includes a watertight door in a frame that has a casket disposed in a channel around the periphery of the door. A knife-edge on the doorframe is positioned to compress the gasket upon latching the door shut. Numerous switches are placed between the channel and the gasket and the switches are closed when the knife-edge edge fully compresses the gasket. A display that is responsive to the switches indicates whether the gasket was sufficiently compressed or not by either a green LED or a red LED respectively.

9 Claims, 2 Drawing Sheets

SEAL COMPRESSION INDICATION SYSTEM

STATEMENT OF GOVERNMENT INTEREST

The invention described herein may be manufactured and used by or for the Government of the United States of America for governmental purposes without payment of any royalties thereon or therefore.

BACKGROUND OF THE INVENTION

The integrity of seals is often a critical element in the operation of various items. Nowhere is this truer than in doors, especially watertight doors, on ships. Watertight doors and hatches are critical to controlling flooding on ships and submarines. These doors often handle large amounts of traffic, cycling the doors open and shut several thousand times a week, causing the seal integrity to fade. Such doors often require extensive adjustments and maintenance in order to maintain a fluid tight closure. The twisting and flexing that occurs on ships cause doors to warp or bend resulting in loss of seal integrity. Other than periodic spot checks, there is currently no way to check the seal integrity on a continuous basis.

The current way to check seal integrity of watertight doors is to perform a chalk test. The chalk test is a simple means of determining if the gasket is in continuous contact with the knife-edge of the doorframe when the door is closed. Chalk is rubbed on the knife-edge of the doorframe and the door is shut and dogged tight. The door is then opened and the chalk line on the seal should be continuous if the door is adjusted properly. A non-continuous chalk line on the gasket indicates that the dogs are not pressing the gasket against the knife-edge properly. However, the chalk test does not guarantee that the door is watertight, as it does not measure seal compression.

Chalk tests are preformed on a periodic basis as it is a labor-intensive test. Doors and doorframes, especially the knife-edges, are subject to wear and tear with repeated use. Additionally, the frames and surrounding structures are often subject to stresses that may warp or bend the frames or surrounding structure. This may mean that even though the chalk test was successful, subsequent damage to the door or frame might occur that causes a bad fit that will not be discovered until the next chalk test.

Another method used to check seal integrity uses acoustic transducers. In this test, transducers are placed on one side of a closed door to produce acoustic energy and the quality of the seal is surmised based on the amount of acoustic energy received. However, such a method is labor intensive and does not-provide continuous feedback.

What is needed is an apparatus that can quickly and continuously determine if the seal is engaged adequately on a closed door.

SUMMARY OF THE INVENTION

In the present invention there is provided a watertight door seal compression indication apparatus that includes a watertight door in a frame that has a gasket disposed in a channel around the periphery of the door. A knife-edge on the doorframe is positioned to compress the gasket upon latching the door shut. A plurality of switches are placed between the channel and the gasket and the switches are closed when the knife-edge edge fully compresses the gasket. A display that is responsive to the switches indicates whether the gasket was sufficiently compressed or not.

In accordance with the invention there is provided a new door seal indication system for indicating the seal compression status of a watertight door on a ship. The system includes a display assembly for indicating the status of the compression of a seal in a door that may be determined by the level of a number of electrically coupled switches that are disposed under the seal and actuate by compression of the seal upon the door closing sufficiently tight. Actuation of all of the switches causes the display assembly to indicate the door is closed properly.

In accordance with another example of the present invention an indication device for displaying the seal compression status of a watertight door seal is provided. The actuation of switches in response to the door shutting indicates a proper seal and any switches not fully actuated upon door closure indicate a faulty seal. The device includes a plurality of switches wired in series disposed under a door seal, and the switches have two states: an open state and a closed state. A display assembly responsive to each of the switch states provides an easy visual key to the status of the seal compression.

Optionally, in the door seal indication system the switches are located at each latching point or dog of the door. In another example, the system display assembly includes a battery and two LEDs to indicate the status. Optionally, the display assembly includes two lights and a power source such as the ship power grid.

For a better understanding of the present invention, together with other and further objects thereof, reference is made to the following description, taken in conjunction with the accompanying drawings, and its scope will be pointed out in the appended claims.

DESCRIPTION OF THE PREFERRED EMBODIMENT

Figure 1:
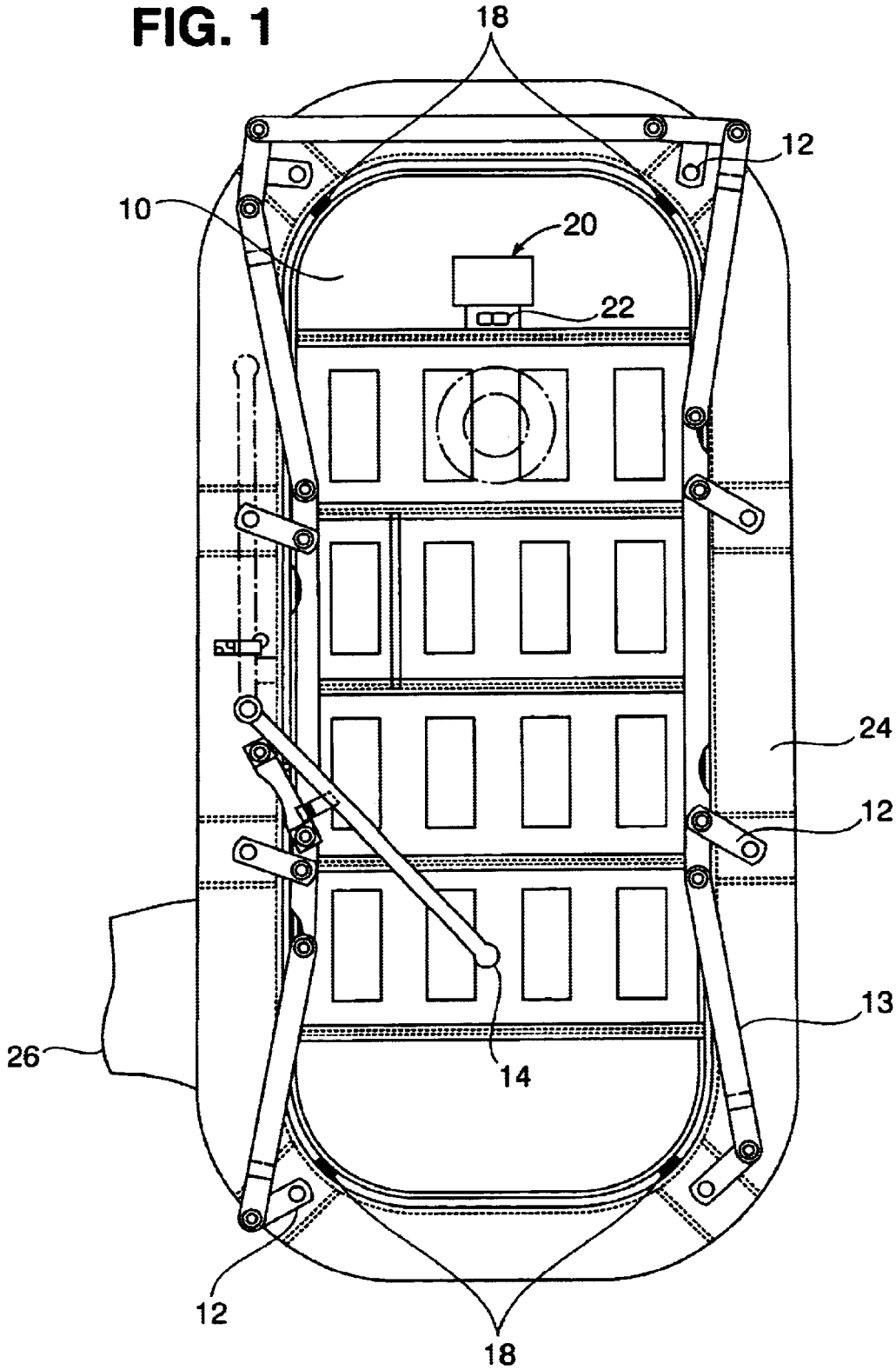
FIG. 1 is a front elevation view of an example shipboard watertight door and doorframe assembly.

Referring now to the example of FIG. 1, a typical shipboard watertight closure is shown. The watertight closure includes a movable door 10 that is attached to the bulkhead 26 by a doorframe 24. The door includes a latching mechanism that includes a door latching handle 14 and numerous dogs 12 that operate through linkages 13 to latch the door 10. The display assembly 20 with indicator lights 22 may be mounted to the face of the door 10.

Figure 2:
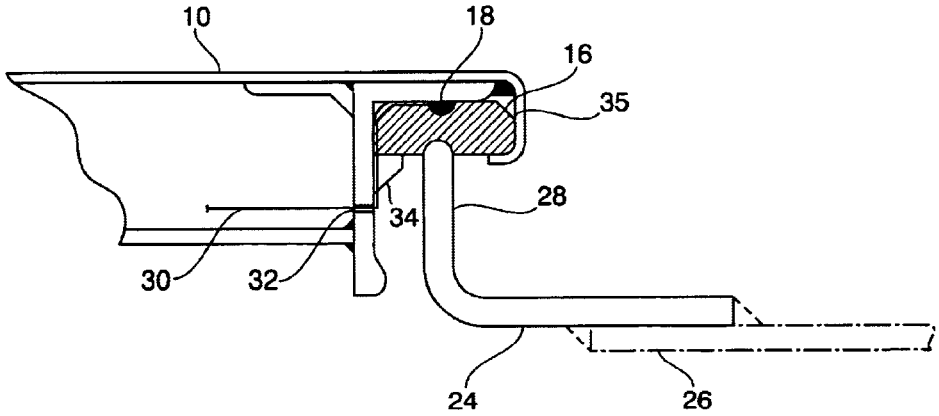
FIG. 2 is an enlarged partial cross sectional view of the switch/gasket in accordance with the present invention.

FIG. 2 is an example of an enlarged partial cross sectional view of the door 10, switch 18 and gasket 16 in accordance with the present invention. When the door 10 is latched the knife-edge 28 of the doorframe 24 compresses the gasket 16 in the channel 35 on the door 10 to form a seal. In an example of the present invention a switch 18 is placed under the gasket 16 at each dog 12 location to indicate when the door is latched or dogged shut properly. The switches 18 may be simple membrane switches though other types of two state switching devices may be easily substituted. The switches 18 are sized to electrically close once the gasket 16 is compressed to a sufficient height by the dogs 12. The approximate minimum depth of compression for a watertight seal is 1/16 inch. Preferably, the gasket 16 may be compressed approximately 1/8 inch. The switches 18 are wired in series and the output of the switches will be wired to indicator lights 22 in an easily visible area of the door 10.

In operation, with a properly adjusted door 10 and dogs 12, if the door 10 is latched closed then the gasket 16 is compressed sufficiently so that all the switches 18 are activated and the circuit completed along transmission wire 30 to the display box 20 as shown in FIG. 1 to light the green LED 22. If the door is not latched properly because it is out of alignment or damaged causing at least one switch 18 to be inactivate, then the red LED 22 will be lit.

The transmission wire 30 in a preferred example runs from the display assembly 20, in series between the switches 18 under the gasket 16 and through notches in the gasket retainer 34. The transmission wire 30 then passes through a small hole 32 in the gasket frame and back to the display assembly 20. The display assembly box 20 is preferably mounted on the face of the door 10 though other locations near the door would also be suitable. The display box 20 preferably houses a battery (not shown) that provides the power for the indicator lights 22 and switch circuits. It would also be possible to supply power from the ship's power plant. Additionally, the invention could be adapted to interface with the damage control systems on a ship so that any watertight door that is open or not sealing properly would be displayed to ships personnel for action.

While there have been described what are believed to be the preferred embodiments of the present invention, those skilled in the art will recognize that other and further changes and modifications may be made thereto without departing from the spirit of the invention, and it is intended to claim all such changes and modifications that fall within the true scope of the invention.

What is claimed is:

1. A door seal indication system for indicating seal compression status of a watertight door on a ship, said system comprising:

a display assembly for indicating the status of compression of a seal in a door;

a plurality of electrically coupled switches disposed under said seal, wherein actuation of all of said switches by compression of said seal causes said display assembly to indicate the door is closed.

2. A door seal indication system as in claim 1, wherein said plurality of switches are located at each latching point of said door.

3. A door seal indication system as in claim 2, wherein said display assembly includes a battery and two LEDs.

4. A door seal indication system as in claim 2, wherein said display assembly includes two lights and a power source.

5. A watertight door seal compression indication apparatus comprising:

a watertight door in a frame;

a gasket disposed in a channel around the periphery of said door;

a closure edge of said frame positioned to compress said gasket upon latching said door shut;

a plurality of switches interposed between said channel and said gasket, wherein said switches electrically close when said closure edge fully compresses said gasket completing the circuit;

a display assembly responsive to said plurality of switches to indicate the status of the gasket compression.

6. A door seal compression indication apparatus as in claim 5, wherein said door includes a plurality of latching points and a switch located at each said latching point.

7. A door seal compression indication apparatus as in claim 6, wherein said status is displayed by a green LED indicating the seal is compressed and a red LED indicating the seal is not compressed.

8. An indication device for displaying the seal compression status of a watertight door seal, wherein the actuation of switches in response to the door shutting indicates a proper seal, said device comprising:

a plurality of switches wired in series disposed under a door seal, wherein said switches have an open state and a closed state; and a display responsive to said switch states.

9. A device as in claim 8, wherein said display includes a red LED responsive to said open state and a green LED responsive to said closed state.

* * * * *

UNITED STATES PATENT AND TRADEMARK OFFICE

CERTIFICATE OF CORRECTION

PATENT NO. : 6,879,256 B1
APPLICATION NO. : 10/654885
DATED : April 12, 2005
INVENTOR(S) : Robert Charles Redfern and Ted Arthur Heinritz It is certified that error appears in the above-identified patent and that said Letters Patent is hereby corrected as shown below:

On the Title Page (57), line 3 of the abstract "casket" should be --gasket--.

Signed and Sealed this

Twelfth Day of February, 2008

JON W. DUDAS
*Director of the United States Patent and Trademark Office*